US006808091B2

(12) United States Patent
Njaastad

(10) Patent No.: US 6,808,091 B2
(45) Date of Patent: Oct. 26, 2004

(54) NOZZLE FOR JUICE DISPENSER

(76) Inventor: David K. Njaastad, 460 S. Whitehall St., Palatine, IL (US) 60067

( * ) Notice: Subject to any disclaimer, the term of this patent is extended or adjusted under 35 U.S.C. 154(b) by 0 days.

(21) Appl. No.: 10/440,329

(22) Filed: May 16, 2003

(65) Prior Publication Data

US 2003/0213819 A1 Nov. 20, 2003

Related U.S. Application Data

(60) Provisional application No. 60/381,269, filed on May 17, 2002.

(51) Int. Cl.[7] ..... B67D 5/56

(52) U.S. Cl. ..... 222/459; 222/129.1; 222/145.6; 239/431; 239/432

(58) Field of Search ..... 222/129.1–129.4, 222/145.5, 145.6, 459, 564, 566; 239/431, 432

(56) References Cited

U.S. PATENT DOCUMENTS

| | | | | | |
|---|---|---|---|---|---|
| 4,509,690 | A | * | 4/1985 | Austin et al. | 239/429 |
| 4,907,725 | A | * | 3/1990 | Durham | 222/129.1 |
| 5,093,058 | A | * | 3/1992 | Harmon et al. | 264/115 |
| 5,269,442 | A | * | 12/1993 | Vogel | 222/129.1 |
| 5,549,222 | A | * | 8/1996 | Schroeder | 222/129.1 |
| 2004/0040983 | A1 | * | 3/2004 | Ziesel | 222/129.1 |

* cited by examiner

*Primary Examiner*—J. Casimer Jacyna
(74) *Attorney, Agent, or Firm*—Pyle & Piontek

(57) ABSTRACT

A dispensing nozzle includes an outer housing defining an interior and a nozzle outlet. A mixing nozzle insert is positioned within the nozzle housing. The insert has a central elongate core that includes a top end that is positioned adjacent inlets for water and juice concentrate, and a bottom end opposite there from adjacent the outlet of the nozzle. The insert includes a concentrate disk on its top end having a perimeter edge positioned closely adjacent an interior surface of the nozzle housing. This disk includes one or more flow holes extending there through. The insert also includes, below the concentrate disk, a plurality of mixing projections having alternating extensions integral with the central core and extending outward there from along the length thereof. The insert and the nozzle housing are designed so that the syrup concentrate is introduced above the concentrate disk and the water is introduced at a level just below the concentrate disk. In operation, when a pour is signaled, concentrate immediately flows through the concentrate disk holes to mix with the water there below. After the pour is stopped, the syrup concentrate is retained above the concentrate disk, as a lack of pressure prevents the concentrate from readily flowing through the orifices thereof. Prior to the following pour, there exists no syrup collected below the concentrate disk that would contribute to an initial pulse of darker concentrate.

6 Claims, 3 Drawing Sheets

NOZZLE FOR JUICE DISPENSER

This application claims benefit of 60/381,269 filed May 17, 2002.

FIELD OF THE INVENTION

The present invention relates generally to beverage dispensing equipment and more specifically to the dispense nozzles used in such equipment.

BACKGROUND OF THE INVENTION

Beverage dispensers of the pre-mix and post-mix type are well known in the art and provide for the dispensing of a wide range of drinks, including sodas and fruit juices. As is well understood, such equipment utilizes dispensing valves having nozzles through which the drink is dispensed into a cup or other receptacle placed there below. Particularly in the case of post-mix dispensing valves wherein a syrup concentrate is mixed with a water diluent, various nozzles insert structures have been devised that serve to insure a good mixing thereof. In the case of fruit juices, and especially where there exists a certain pulp fraction, a further concern relates to pour initiation. Where a substantial period of time has elapsed between dispensings, the juice concentrate can migrate to a bottom position of the nozzle. At the initiation of the next pour, this pure concentrate fraction is first dispensed followed by a very dilute water pulse. The water pulse results form the fact that there can exist a slight lag in time with respect to the flow of syrup due to this draining downward of the concentrate. Thus, the syrup needs to "catch up" to the water thereby initially resulting in a short pulse of mostly water. This lack of homogeneity is visibly apparent during the first few moments of the dispense as the concentrate is darker or more opaque than the water. Accordingly, it would be desirable to have a juice nozzle structure that provides for thorough mixing during the entire dispense and that eliminates the undesirable appearance of a non-homogeneous flow of liquid.

SUMMARY OF THE INVENTION

The dispensing nozzle of the present invention includes an outer housing defining an interior and a nozzle outlet. A mixing nozzle insert is located in the housing interior and has a central elongate core and includes a top end that is positioned adjacent inlets for the water and juice concentrate, and a bottom end opposite there from adjacent the nozzle outlet. The insert includes a concentrate disk on its top end having a perimeter edge positioned closely adjacent an interior surface of the nozzle housing. This disk includes one or more flow holes extending there through. The insert also includes a plurality of mixing disks or extensions integral with its central core and extending outward there from along the length thereof. At the bottom end of the insert there exists a plurality of legs integral there with and extending downward there from. The insert and the nozzle housing are designed so that the syrup concentrate is introduced above the concentrate disk and the water is introduced at a level just below the concentrate disk.

In operation, when a pour is signaled, the valve simultaneously delivers the concentrate through concentrate disk holes to mix with the water there below. The water and syrup are then more fully mixed as they subsequently pass through the plurality of mixing disks and ultimately flow out the nozzle outlet. The plurality of legs serve to provide for a more uniform stream and flow of the juice mixture from the nozzle outlet. It can be appreciated by those of skill that upon stopping a dispense, the syrup concentrate is retained above the concentrate disk as the lack of pressure, once the flow is stopped, prevents the concentrate from flowing through the orifices thereof. Therefore, prior to the following pour, no syrup can migrate and collect at a lower point in the nozzle. As a result thereof, when the next pour is initiated there exists no initial pulse of darker concentrate. Moreover, as a portion of juice concentrate is held immediately above the concentrate disk, it can immediately mix with the incoming water thereby eliminating the flow lag there between and a following pulse of essentially pure water.

DESCRIPTION OF THE DRAWINGS

A better understanding of the structure, operation and the objects and advantages of the present invention can be had by reference to the following detailed description which refers to the following figures, wherein.

DETAILED DESCRIPTION OF THE PREFERRED EMBODIMENT

Figure 1:
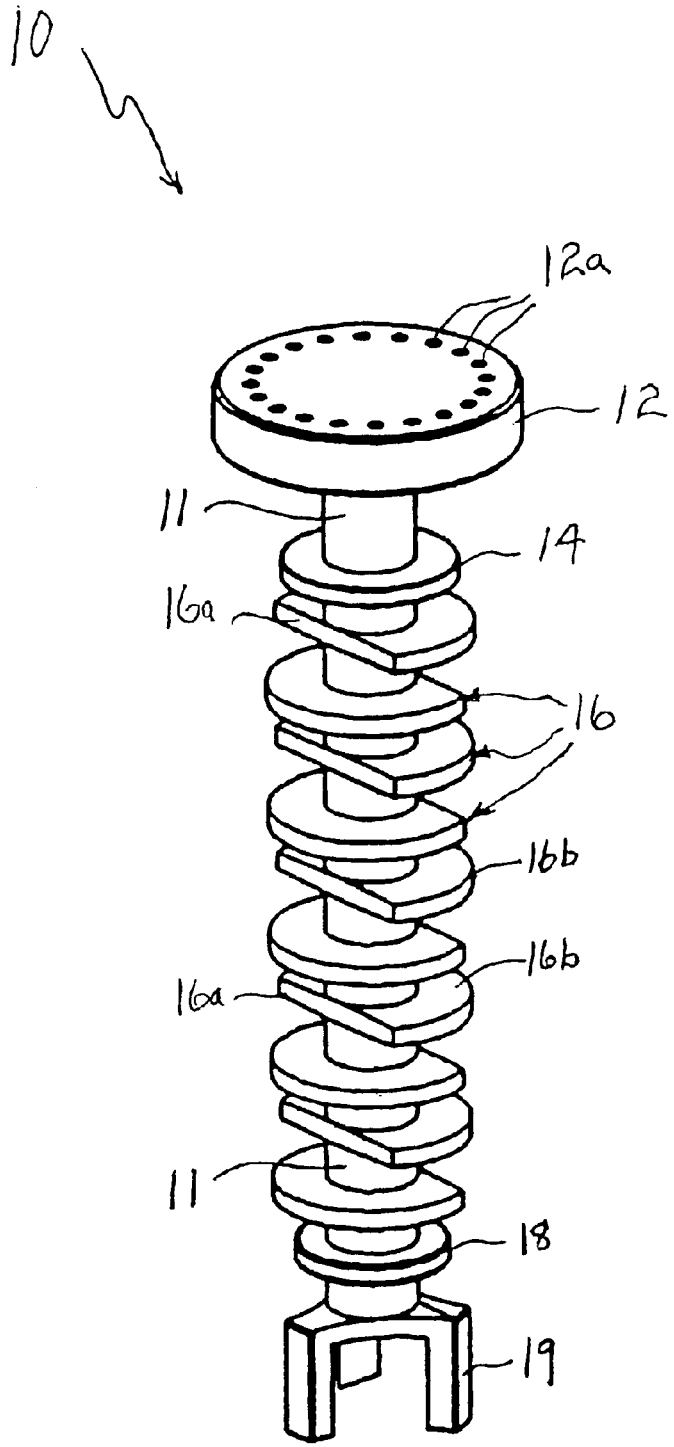
FIG. 1 shows a perspective view of the nozzle insert of the present invention.
Figure 2:
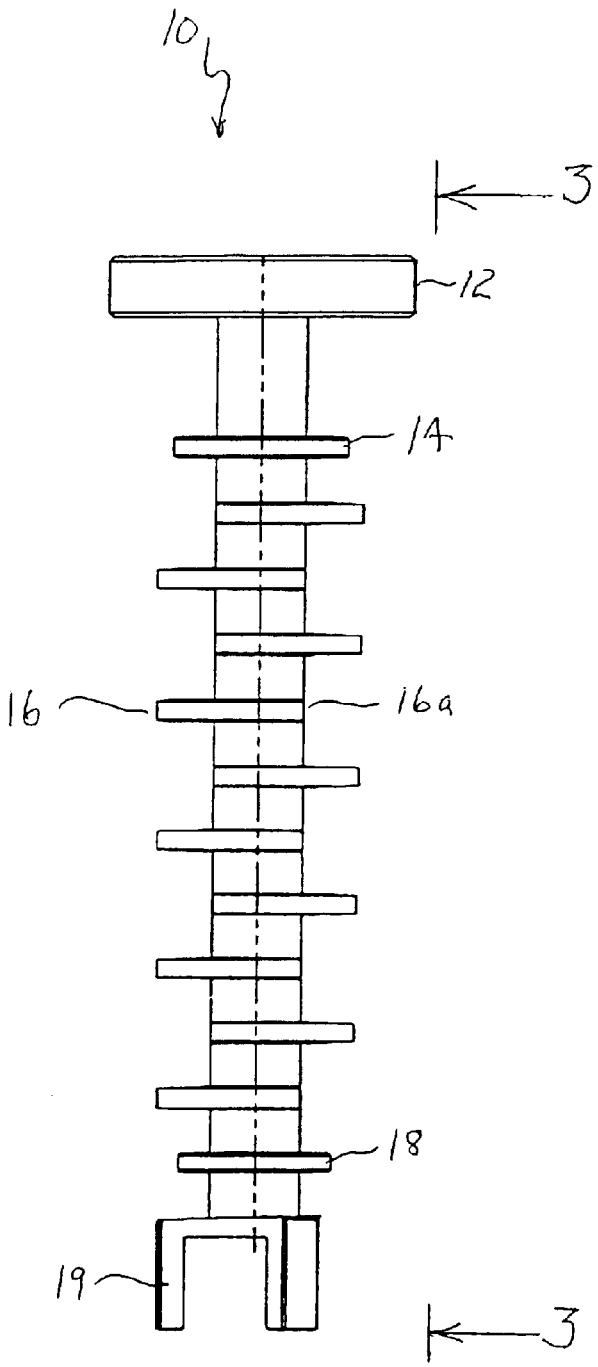
FIG. 2 shows a side plan view of the insert of the present invention.
Figure 3:
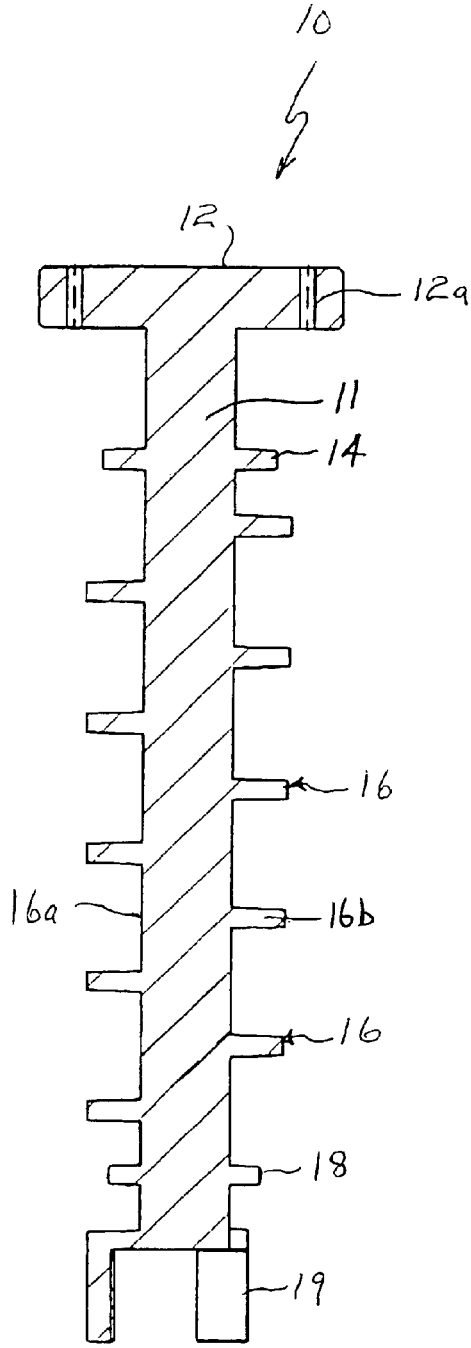
FIG. 3 shows a cross-sectional view along lines 3—3 of FIG. 2.

The nozzle insert of the present invention is seen in FIGS. 1 and 2 and is generally referred to by the numeral 10. Insert 10 is preferably manufactured as a molded plastic structure being elongate and having a central axial core 11. A concentrate flow disk 12 is integral with core 11 and is positioned at a top end thereof and includes a plurality of flow orifices 12*a* extending there through. Immediately below disk 12 is a water spreading disk 14 followed by a plurality of mixing projections or flanges 16 all integral with and extending transversely from the central core 11. In the preferred embodiment shown flanges 16 comprise circular disks 16, however disks 16 are not fully circular and include partial or removed side portions 16*a* and full portions 16*b* which, as seen in FIGS. 2 and 3, alternate from side to side with each subsequent disk 16. Insert 10 further includes a flow spreading disk 18 positioned below the disks 16. A plurality of flow legs 19 are integral with insert 10 and extend there from below disk 18.

Figure 4:
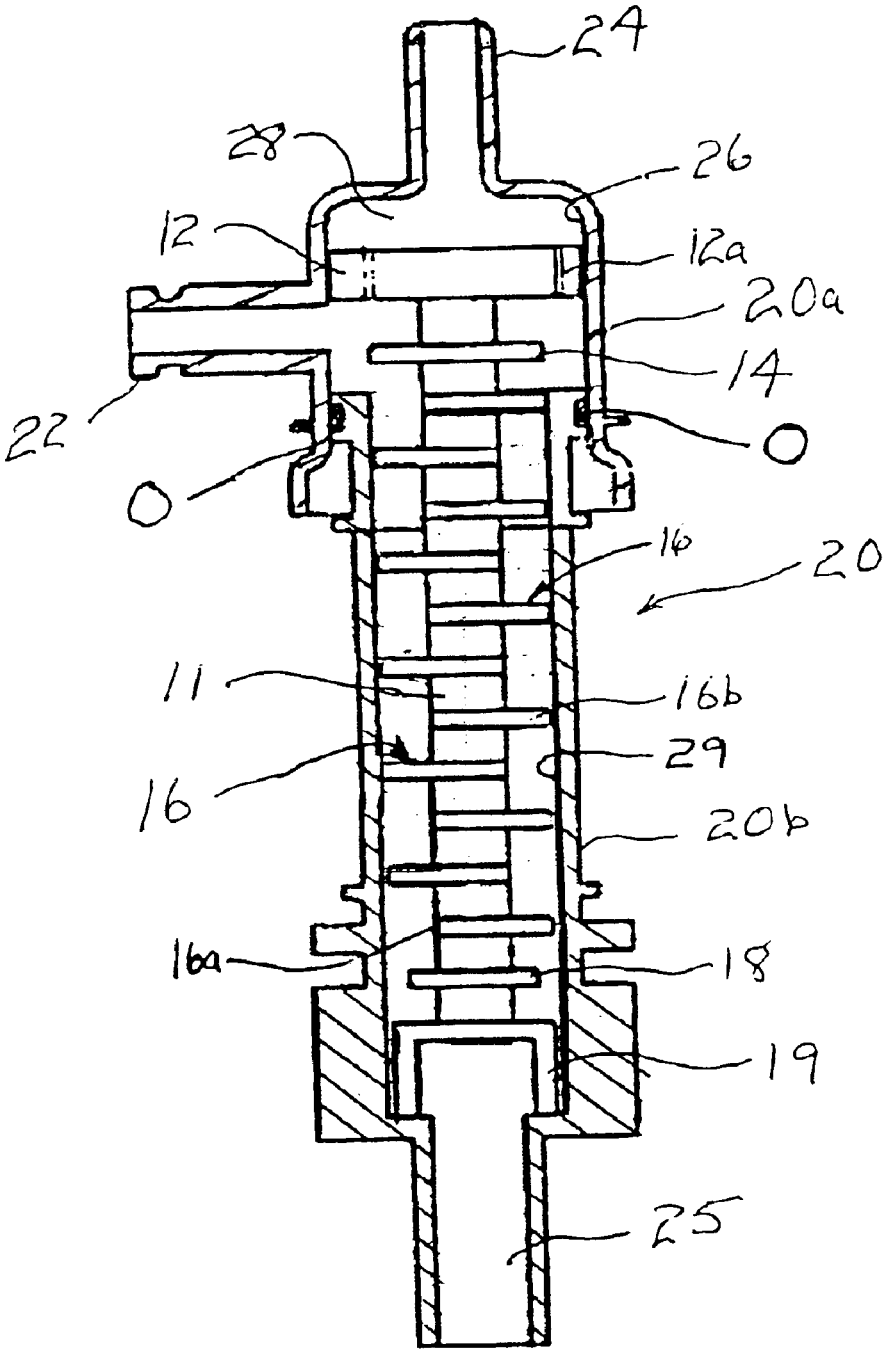
FIG. 4 shows a view of the nozzle insert of the present invention in a cross-section of the nozzle housing.

As seen by referring to FIG. 4, insert 10 is shown in the context of a nozzle housing 20. Housing 20 consists of an upper portion 20*a* and a lower portion 20*b*. Upper portion 20*a* includes a water inlet 22, connected to a pressurized source of water, not shown, and a syrup concentrate inlet 24 connected to a pressurized source of concentrate, also not shown. Lower portion 20*b* serves to define a nozzle outlet 25 and includes an o-ring O retained in an annular groove. Those of skill will understand that insert 10 is retained or captured between portions 20*a* and 20*b* wherein a top end of housing bottom portion 20*b* is received within top portion 20*a* and held fluid tightly sealed there with by o-ring O. Thus, it can be seen that insert 10 is releasably and sealingly held there between. It can also be seen that the perimeter edge of concentrate disk 12 is in close contact with an interior surface 26 of upper housing portion 20*a* and that there exists a concentrate retaining volume 28 above disk 12. The major or circular portions 16*b* of disks 16 are sized to extend closely to an interior surface 29 of lower housing portion 20*b*.

In operation, when a dispense is initiated, those of skill will understand that flows of water and syrup enter inlets 20 and 24 respectively. The syrup flows through disk orifices 12*a* and then mixes with water immediately below or down stream of disk 12. Disk 14 serves to direct the water outwardly towards interior surface 26. The disks 16 then serve to further mix the water and syrup as such flows downstream along insert 10 following the alternating or back and forth mixing flow path resulting from the alternating or staggered structure of disks 16. Those of skill will understand that a wide variety of mixing projections could extend from core 11 and into the flow of juice and water and provide for turbulation of that flow in order to enhance mixing thereof. Disk 18 serves to spread the flow of mixed drink outward toward the interior surface of housing 20*b* and, along with the flow direction then provided by legs 19 downstream thereof, control such flow of juice for producing a more even and visually attractive flow exiting nozzle opening 25. As is well understood, when a desired volume of drink has been dispensed, the pour is stopped by a valve structure, not shown, that ceases the pressurized flows of water and concentrate to the nozzle of the present invention. Those of skill can understand that a volume of concentrate is retained above disk 12 as the orifices 12*a* are sized sufficiently small, e.g. having diameters of approximately 0.047 inch wherein disk 12 has a diameter of approximately 1.000 inch and a thickness of approximately 0.200 inch, for a flow rate of approximately 1 to 3 ounces per second, that the concentrate can not flow there through. As a result thereof, that volume of concentrate is not permitted to flow by force of gravity downward in the nozzle and collect on the lower of the disks 16. Thus, the next pour does not experience a first pulse of primarily concentrate. Moreover, as the first volume of concentrate is ready to immediately mix with the incoming water, a following pulse of water is eliminated. Therefore, the nozzle insert of the present invention provides for an even mixing of concentrate and water and dispenses a drink in a desired homogeneous appearing manner.

What is claimed is:

1. A dispensing nozzle, comprising:

A nozzle housing for retaining a nozzle insert therein, and having a top end having a concentrate inlet and a water inlet and the nozzle housing defining a flow outlet at a bottom end thereof, a nozzle insert having a top end and a bottom end, the top end thereof having a concentrate flow disk having one or more flow orifices extending there through and having a perimeter edge that is held in close contact with an interior surface of the nozzle housing when the nozzle insert is retained therein, and the concentrate inlet in fluid communication with an interior area of the nozzle housing above the concentrate flow disk and the water inlet positioned below the concentrate flow disk, a plurality of mixing projections extending from and along a central core of the nozzle insert that extends between the concentrate disk and the bottom end thereof.

2. The nozzle as defined in claim 1 and the nozzle insert having a flow spreading disk at the bottom end thereof downstream of the mixing projections and one or more flow directing legs downstream of the flow spreading disk for providing a controlled flow of juice out of the flow outlet.

3. The nozzle as defined in claim 1 and the mixing projections comprising partial disks extending transversely from the central core.

4. The nozzle as defined in claim 2 and the disks having alternating full and partial portions.

5. The nozzle as defined in claim 1 and including a second flow spreading disk at the top end thereof below the concentrate flow disk.

6. The nozzle as defined in claim 1 and the nozzle housing comprising an upper portion and a lower portion releasably and fluid sealingly held together and the nozzle insert held therein and there between.

* * * * *